United States Patent [19]

Yamakami et al.

[11] 3,998,747

[45] Dec. 21, 1976

[54] COLOR TONER FOR ELECTROPHOTOGRAPHY

[75] Inventors: Hiroshi Yamakami, Tokyo; Kaichi Tsuchiya, Fuchu; Seizi Tomari, Yokohama, all of Japan

[73] Assignee: Canon Kabushiki Kaisha, Tokyo, Japan

[22] Filed: Sept. 26, 1974

[21] Appl. No.: 509,740

[30] Foreign Application Priority Data

| | | |
|---|---|---|
| Oct. 2, 1973 | Japan | 48-110734 |
| Oct. 8, 1973 | Japan | 48-113064 |
| Aug. 22, 1974 | Japan | 49-96501 |

[52] U.S. Cl. ..... 252/62.1 R; 8/4; 96/1 R; 96/1.2; 252/62.1 P; 260/40 R

[51] Int. Cl.[2] ..... G03G 9/12

[58] Field of Search ..... 252/62.1 P, 62.1 R; 260/40 R; 8/4; 96/1 R, 1.2

[56] References Cited

UNITED STATES PATENTS

| | | | |
|---|---|---|---|
| 3,345,293 | 10/1967 | Bartoszewicz et al. | 252/62.1 P |
| 3,590,000 | 6/1971 | Palermiti et al. | 252/62.1 P |
| 3,597,368 | 8/1971 | Honjo et al. | 252/62.1 L |
| 3,736,257 | 5/1973 | Miller | 252/62.1 P |
| 3,844,815 | 10/1974 | Parent et al. | 252/62.1 |
| 3,909,259 | 9/1975 | Mammino et al. | 252/62.1 P |

*Primary Examiner*—Mayer Weinblatt
*Assistant Examiner*—John D. Smith
*Attorney, Agent, or Firm*—Fitzpatrick, Cella, Harper & Scinto

[57] ABSTRACT

A negatively charged color toner for electrophotography composed of a polyester resin obtained by the reaction of polyol and dicarboxylic acid components and an organic pigment.

11 Claims, No Drawings

COLOR TONER FOR ELECTROPHOTOGRAPHY

BACKGROUND OF THE INVENTION

1. Field of the Invention

This invention relates to a toner composition of negative charging property for use in developing an electrostatic latent image in electrophotography. More particularly, the invention is concerned with magenta, yellow, and cyan toners useful in color electrophotography.

2. Description of the Prior Art

U.S. Pat. No. 2,297,691, Japanese Patent Publication No. 42-23910, Japanese Patent Publication No. 43-24748, and others describe various methods for electrophotography. In general, the electrophotographic technique is carried out by first forming a latent image on a photosensitive body by various electrical means or expedients using a photoconductive substance, then developing the thus formed electrical latent image by a toner, transferring the developed and powdered image onto a recording material such as paper, depending on necessity, and finally fixing the powdered image by heating or with a solvent vapor, and so forth.

On the other hand, there have been known various methods of obtaining color images by these conventional electrophotographic techniques, wherein an original image is first exposed through a color resolving filter, and an electrostatic latent image thus obtained is developed by the use of a color toner (magenta toner, cyan toner, and yellow toner) corresponding to the color resolving filter, through which the original image has been exposed. The toner images of each color obtained by carrying out these process steps are then superimposed to produce the final color image.

The abovementioned magenta toner, cyan toner, and yellow toner to be used for such color electrophotography, unlike the black toner being used in the ordinary electrophotography, are required to satisfy various conditions as mentioned below.

1. To have high transparency for the sake of superimposing multi-color images.

2. To have preferential or selective electric charge, either positive or negative.

3. The formed image has excellent stability against heat and light, and excellent anti-bleeding property.

4. The toner has excellent spectral reflective characteristics to reproduce an original image with high fidelity.

Unfortunately, however, it is considerably difficult to satisfy these conditions simultaneously. Particular difficulty resides in obtaining a color toner which exhibits a negative electric charging property, has high transparency, and good spectral and reflective characteristics simultaneously.

Heretofore, the negatively charging toner has been produced by mixing metal-containing dyes (reddish black, bluish black) capable of imparting the negatively charging property to the toner (as disclosed in Japanese Patent Publication Nos. 41-20153, 43-27596, 44-6397 and 45-26478) with a binder resin for the toner together with carbon black, etc. While this process holds good with the production of black toners having the negatively charging property, it does not give favorable results in obtaining color toners since inclusion of the metal-containing dyes in the color toner composition inevitably curtails the color tone of the toner and no toner having high color purity can therefore be obtained.

SUMMARY OF THE INVENTION

In order to eliminate such difficulty inherent in the conventional methods and to obtain suitable color toners of high color purity and negatively charging property, the present inventors have conducted research and studies on various combinations among many kinds of binder resins and many kinds of magenta, cyan and yellow pigments and dyes. As the result, they have obtained satisfactory color toners of negatively charging property which meet the afore-mentioned requisite conditions for the color toner.

It is therefore an object of the present invention to provide a color toner of negatively charging property for use in the reproduction of a color image in color electrophotography, and having high transparency and excellent spectral reflective characteristics.

It is another object of the present invention to provide a color toner of negatively charging property for use in color electrophotography and having excellent heat-resistant, light-resistant, and anti-bleeding properties.

The foregoing objects and other objects as well as the precise compositional ratio and class of ingredients to be used for the practice of the present invention will become more apparent from the following detailed description thereof when read in conjuction with preferred embodiments of the invention.

According to the present invention, there is provided a toner for electrophotography having a negatively charging property which comprises a saturated or unsaturated polyester resin having a soltening point of from 80° to 150° C and produced from a polyol component and a dicarboxylic acid component and an organic pigment selected from quinacridone type magenta organic pigments, rhodamine type magenta organic pigments, phthalocyanine type cyan organic pigments and benzidine type yellow organic pigments.

DESCRIPTION OF THE PREFERRED EMBODIMENTS

The softening point of the saturated or unsaturated polyester resin ranges from 80° to 150° C, preferred with 90°–110° C, (according to the Ball and Ring Method).

As to the amounts of ingredients, it is preferable to use 100 parts by weight of the polyester and 1–15 parts by weight, preferably 2–8 parts by weight, of the organic pigment.

According to the present invention, there is provided a toner having satisfactory negatively charging property, high transparency, excellent spectral reflective characteristics, which has been realized by the combination of the aforementioned specific resin and the specific organic pigments for the magenta, cyan, and yellow toners.

This specific combination of the polyester resin and the organic pigment is extremely important in that no other combinations would produce color toners of sufficient negatively charging property and color purity. The combination according to the present invention is also optimum in producing a color toner of excellent heat-resistant, light-resistant, and anti-bleeding properties.

The polyester resins having the softening point of from 80° to 150° C to be used for the purpose of the present invention are produced from a polyol component and a dicarboxylic acid.

For the polyol component, there can be exemplified ethylene glycol, triethylene glycol, 1,2-propylene glycol, 1,3-propylene glycol, 1,4-butanediol, neopentyl glycol, 1,4-butene diol, 1,4-bis(hydroxymethyl) cyclohexane, bisphenol A, hydrogenated bisphenol A, polyoxyethylenated bisphenol A, and so forth. Of these, propylene glycol, neopentyl glycol, and bisphenol A are particularly preferable.

For the dicarboxylic acid component, on the other hand, there can be exemplified maleic acid, fumaric acid, mesaconic acid, citraconic acid, itaconic acid, glutaconic acid phthalic acid, isophthalic acid, terephthalic acid, cyclohexane dicarboxylic acid, succinic acid, adipic acid, sebacic acid, malonic acid, oxalic acid, anhydrides of these acids, or esters of these acids with lower alcohols.

The following, typical examples of the polyester resins for use in the present invention will be given.

1. Polyester Resin A

The resin obtained by reacting the following components at a temperature of from 170° to 200° C for four hours.

| | |
|---|---|
| Propylene glycol | 5.25 mols |
| Fumaric acid | 5.00 mols |
| Softening Point | 113° C |

In the following (2)–(8) the reaction was carried out under conditions similar to those as above.

2. Polyester Resin B

The reaction product of the following components.

| | |
|---|---|
| Neopentyl glycol | 5.00 mols |
| Fumaric acid | 5.00 mols |
| Softening Point | 96° C |

3. Polyester Resin C

The reaction product of the following components.

| | |
|---|---|
| Propylene glycol | 5.25 mols |
| Maleic Anhydride | 2.5 mols |
| Phthalic Anhydride | 2.5 mols |
| Softening Point | 110° C |

4. Polyester Resin D

The reaction product of the following components.

| | |
|---|---|
| Propylene glycol | 5.25 mols |
| Maleic Anhydride | 5.00 mols |
| Softening Point | 92° C |

5. Polyester Resin E

The reaction product of the following components.

| | |
|---|---|
| Neopentyl glycol | 7.35 mols |
| Fumaric acid | 7.00 mols |
| Softening Point | 88° C |

6. Polyester Resin F

The reaction product of the following components.

| | |
|---|---|
| Bisphenol A | 2.0 mols |
| Fumaric acid | 2.0 mols |
| Softening Point | 140° C |

7. Polyester Resin G

The reaction product of the following components.

| | |
|---|---|
| Propylene glycol | 2.0 mols |
| Neopentyl glycol | 3.15 mols |
| Fumaric acid | 5.00 mols |
| Softening Point | 98° C |

8. Polyester Resin H

The reaction product of the following components.

| | |
|---|---|
| Propylene glycol | 2.1 mols |
| Neopentyl glycol | 3.15 mols |
| Fumaric acid | 3.32 mols |
| Phthalic Anhydride | 1.68 mols |

The above-enumerated polyester resins yield particularly favorable results with the present invention.

The benzidine type yellow organic pigments to be used in the present invention are derivatives of 3,3'-dichlorobenzidine, which include, for example, Pigment Yellow 12, Symuler Fast Yellow GF (having Color Index No. C.I.21090), Pigment Yellow 14, Benzidine Yellow G, Benzidine Yellow I.G, Vulcan Fast Yellow G, Benzidine Yellow OT, Symuler Fast Yellow 5GF (having Color Index No. C.I.21095), Pigment Yellow 13, Benzidine Yellow GR, Permanent Yellow GR. Symuler Fast Yellow GRF (having Color Index No. C.I.21100), and so forth.

As to the phthalocyanine type organic pigment, those having the color index Nos. C.I.74260, C.I.74280, C.I.74255, C.I.74160, C.I.74180, and so on are particularly favorable. When these pigments are used in combination with the polyester resins according to the present invention, there can be obtained a toner having a very strong negatively charging property.

As the quinacridone type or rhodamine type magenta organic pigments used in the present invention, pigment Red 81 (C.I.45160) and Pigment Red 122 are particularly preferable.

"Pigment Red 81" includes:
Seikalight Rose 81 (Dainichi Seika, Japan)
Symulex Rhodamine Y (Dainippon Ink. Japan)
Irgalite Brillred TCR (Geigy)
"Pigment Red 122" includes:
Permanent Pink E (Hoechst, W. Germany)
Fastogen Magenta RS-11 (Dainippon Ink, Japan)

When the above-enumerated organic pigments are used in combination with the afore-mentioned polyester resins, they exhibit remarkable transparency, coloring property, light-resistance, heat-resistance, and anti-bleeding property, so that they are suitable as color toners.

Accordingly, when the abovementioned specific polyester resins and the abovementioned various organic pigments are mixed and kneaded in a molten state by the conventionally known methods, followed by pulverization of the kneaded mixture to a particle size of about 1 to 30 microns, there can be obtained various classes of magenta toner, cyan toners, and yellow toners of negatively charging property, and such other desirable and excellent properties as high transparency, spectral characteristics, light-resistance, heat-resistance, and anti-bleeding property without accompanying color fading with lapse of time. These color toners are then mixed with a carrier such as iron powder, fur, glass beads, and so forth to be made into a developing agent for the dry-type color electrophotography.

EXAMPLES 1 THROUGH 17

Various combinations of the polyester resins and the magenta organic pigments as shown in the following Table 1 were crushed and mixed in a ball mill, and then each mixture was sufficiently kneaded in a molten state in a roll mill at a temperature of approximately 140° C. After cooling the kneaded mixture, it was roughly crushed by use of a hammer mill, followed by pulverization into very fine particles by means of an air-jet type pulverizer (pressure for pulverization = 5 to 6 kg/cm$^2$; rate of feeding = 310 kg/hr). The thus obtained fine particles were classified by a classifier to select the particle size range of from 5 to 30 microns. The color purity of these toners is also shown in Table 1 below.

To 20 parts by weight of the thus obtained toner, there was added 80 parts by weight of iron powder as the carrier (a product of Nippon Teppun K.K., Japan and available under a tradename of "EF 300 - EF 500") to prepare a developing agent. The triboelectric quantity of the toner, at this time, is also shown in Table 1 below.

When the image recording was conducted in a dry-transfer type electrophotographic reproduction apparatus (a product of Canon K.K., Japan: Machine (Model "NP-1100") by using the abovementioned developing agent, a very clear positive image in magenta color could be obtained.

Table 1

| Example | Binder Resin (wt. part) | | Pigment (wt. part) | | Triboelectric Quantity (μc/g) | Color Purity (%) |
|---|---|---|---|---|---|---|
| 1 | Polyester Resin A | 100 | Permanent Pink E (Pigment Red 122 of Hoechst) | 5 | −4.1 | 62 |
| 2 | Polyester Resin B | " | " | " | −5.7 | 61 |
| 3 | Polyester Resin C | " | " | " | −3.8 | 63 |
| 4 | Polyester Resin D | " | " | " | −4.2 | 64 |
| 5 | Polyester Resin E | " | " | " | −5.2 | 60 |
| 6 | Polyester Resin F | " | " | " | −9.5 | 59 |
| 7 | Polyester Resin G | " | " | " | −7.4 | 60 |
| 8 | Polyester Resin H | " | " | " | −8.1 | 62 |
| 9 | Polyester Resin F | " | Seika Light Rose R-40 (Pigment Red 81 of Dainichi Seika) | " | −8.0 | 60 |
| 10 | Polyester Resin F | " | " | 1 | −13.7 | 69 |
| 11 | " | " | " | 2 | −10.3 | 65 |
| 12 | " | " | " | 3 | −10.0 | 61 |
| 13 | Polyester Resin F | 100 | Seika Light Rose R-40 (Pigment Red 81 of Dainichi Seika) | 4 | −8.5 | 60 |
| 14 | " | " | " | 6 | −7.2 | 52 |
| 15 | " | " | " | 7 | −5.1 | 55 |
| 16 | " | " | " | 8 | −4.3 | 47 |
| 17 | " | " | " | 9 | −3.5 | 40 |

(Note: The polyester resins A to H are those described above.

For the sake of comparison, the color purity and triboelectric quantity of toners prepared by using various other kinds of binder resins are shown in Table 2 below. The comparative Examples 1 through 11 inclusive were conducted in the same manner as mentioned in Examples 1 to 17, except for the binder resins.

Table 2

| Comparative Example | Binder Resin (wt. Part) | | Pigment (wt. part) | | Triboelectric Quantity (μc/g) | Color Purity (%) |
|---|---|---|---|---|---|---|
| 1 | Polystyrene Resin ("PICCOLASTIC-D") | 100 | Permanent Pink E | 5 | −0.2 | 40 |
| 2 | Polystyrene Resin ("Himer-SU 135") | " | " | " | −0.1 | 42 |
| 3 | Epoxy Resin ("ARALDITE 6084") | " | " | " | +0.4 | 45 |
| 4 | Epoxy Resin ("EPIKOTE 1004") | " | " | " | +0.3 | 46 |
| 5 | Phenolic Resin | " | Seikalight Rose R-40 | " | −4.3 | 51 |
| 6 | Coumarone-Indene Resin | " | " | " | −3.8 | 55 |
| 7 | Polyterpene Resin | " | " | " | +3.1 | 63 |
| 8 | Rosin-modified Maleic Acid Resin | " | " | " | −0.4 | 42 |
| 9 | Rosin-modified Phenolic Resin | " | " | " | −0.9 | 57 |
| 10 | Xylene Resin | " | " | " | +2.7 | 42 |
| 11 | Styrene-Methacrylate Copolymer Resin | " | " | " | −0.1 | 40 |

In the foregoing actual preferred examples and the comparative examples, the color purity was measured by means of a color-difference meter (manufactured by Nippon Denshoku k.k., Japan). Also, the triboelectric quantity ($\mu c/g$) was measured in accordance with the following procedures.

1. A small quantity of the toner was mixed with an appropriate quantity of iron powder as the carrier (EF 100–150 mesh) to prepare the developing agent. This developing agent was then placed in a measuring device and weighed together with the device.

2. Then, this measuring instrument was connected to a volt-meter (manufactured by Takeda Riken K.K., Japan, Model TR-8651). After the measurement, the toner in the developing agent was removed by a cleaner at the bottom side of the measuring device. In the course of this cleaning action, the needle of the volt-meter oscillates. This oscillation of the needle was stopped at an appropriate point of the graduation, whereupon the measuring instrument is detached from the volt-meter to weigh the amount of the developing agent left on the balance. Thereafter, the value of the voltage already read from the measuring instrument is divided by the quantity of the toner reduced to obtained the value of voltage per gram of the toner. The quotient is multiplied by a capacitance value of a capacitor in the measuring instrument to obtain the triboelectric potential value T, as follows.

$$(v/9 \times 0.47\mu F = T\ \mu c/g)$$

EXAMPLES 18 THROUGH 33

Various combinations of polyester resins and phthalocyanine type blue organic pigments as shown in Table 3 below were ground and mixed in a ball mill, and then sufficiently kneaded in a molten state in a roll mill at a temperature of approximately 140° C. After cooling the kneaded mixture, it was roughly crushed by using a hammer mill, followed by pulverization to produce very fine particles by means of an air-jet type pulverizer, whereby toners were obtained.

With this toner material, various sorts of developing agents were prepared in the same manner as in Example 1 above. The color purity and the triboelectric quantity of these cyan toners are as shown in Table 3 below.

Table 3

| Example | Binder Resin (wt. Part) | | Pigment (wt. part) | | Triboelectric Quantity ($\mu c/g$) | Color Purity (%) |
|---|---|---|---|---|---|---|
| 18 | Polyester Resin A | 100 | Symuler Fast Blue 5007 (C.I. 74260: a product of Dainippon Ink. K.K.) | 6 | −4.20 | 64.1 |
| 19 | Polyester Resin B | " | " | " | −4.28 | 59.0 |
| 20 | Polyester Resin C | " | C.I. 74280 | " | −5.42 | 65.1 |
| 21 | Polyester Resin D | " | C.I. 74255 | " | −10.7 | 58.0 |
| 22 | Polyester Resin E | " | C.I. 74260 | " | −6.40 | 68.1 |
| 23 | Polyester Resin F | " | " | " | −8.97 | 49.2 |
| 24 | Polyester Resin G | " | " | " | −6.25 | 63.4 |
| 25 | Polyester Resin H | " | " | " | −6.83 | 52.0 |
| 26 | Polyester Resin F | " | C.I. 74160 | " | −7.74 | 55.8 |
| 27 | " | " | C.I. 74260 | " | −8.20 | 62.0 |
| 28 | " | " | C.I. 74180 | " | −7.35 | 60.7 |
| 29 | " | " | C.I. 74260 | 3 | −10.2 | 58.7 |
| 30 | " | " | " | 5 | −9.83 | 56.1 |
| 31 | " | " | " | 7 | −7.85 | 58.0 |
| 32 | " | " | " | 10 | −7.04 | 54.6 |
| 33 | " | " | " | 13 | −6.81 | 67.9 |

For the sake of comparison, the color purity and triboelectric quantity of the toners prepared by using various kinds of binder resins other than those used in the present invention are shown in the following Table 4.

Table 4

| Comparative Example | Binder Resin (wt. part) | | Pigment (wt. part) | | Triboelectric Quantity ($\mu c/g$) | Color Purity (%) |
|---|---|---|---|---|---|---|
| 12 | Polystyrene Resin ("PICCOLASTIC-D-125") | 100 | C.I. 74260 | 6 | +0.54 | 48.5 |
| 13 | Polystyrene Resin ("HIMER-SU 135") | " | " | 8 | +0.42 | 46.0 |
| 14 | Epoxy Resin ("ARALDITE 6084") | " | " | 6 | +0.39 | 47.6 |
| 15 | Epoxy Resin ("EPIKOTE 1004") | " | C.I. 74280 | " | +0.47 | 52.3 |
| 16 | Xylene Resin | " | C.I. 74260 | " | +0.56 | 44.7 |
| 17 | Coumarone-Indene Resin | " | C.I. 74255 | " | +0.44 | 42.1 |
| 18 | Polyterpene Resin | " | C.I. 74160 | " | +0.58 | 52.0 |
| 19 | Rosin-modified Maleic Acid Resin | " | C.I. 74180 | " | −0.35 | 43.1 |
| 20 | Rosin-modified Phenolic Resin | " | C.I. 74260 | " | −0.44 | 46.5 |
| 21 | Styrene-Methyl-methacrylate Copolymer Resin (1:1) | " | C.I. 74280 | " | −0.10 | 43.0 |

EXAMPLES 34 THROUGH 49

Various combinations of polyester resins and benzidine-type yellow organic pigments as shown in the following Table 5 were ground and mixed in a ball mill, and then sufficiently kneaded in the molten state in a roll mill at a temperature of approximately 140° C. After cooling the kneaded mixture, it was roughly crushed by use of a hammer mill, followed by pulverization to produce very fine particles by means of an air-jet type pulverizer (pressure for pulverization = 5 to 6 kg/cm$^2$; rate of feeding = 310 kg/hr.). The thus obtained fine particles were classified by a classifier to select the particle size range of from 5 to 30 microns, to obtain the yellow toner.

With this yellow toner, various sorts of developing agents were prepared in the same manner as in Example 1 above. The color purity and the triboelectric quantity are as shown in Table 5 below.

Table 5

| Example | Binder Resin (wt. part) | | Pigment (wt. part) | | Triboelectric Quantity (μc/g) | Color Purity (%) |
|---|---|---|---|---|---|---|
| 34 | Polyester Resin A | 100 | Symuler Fast Yellow-GF (C.I. 21090: a product of Dainippon Ink. K.K.) | 6 | −3.82 | 83 |
| 35 | Polyester Resin B | " | " | " | −5.10 | 81 |
| 36 | Polyester Resin C | " | " | " | −3.21 | 84 |
| 37 | Polyester Resin D | " | " | " | −3.42 | 80 |
| 38 | Polyester Resin E | " | " | " | −4.33 | 79 |
| 39 | Polyester Resin F | " | " | " | −10.78 | 79 |
| 40 | Polyester Resin G | " | " | " | −6.75 | 81 |
| 41 | Polyester Resin H | " | " | " | −7.28 | 83 |
| 42 | Polyester Resin F | " | Symuler Fast Yellow-GRF (C.I. 21100: a product of Dainippon Ink k.k.) | " | −8.53 | 80 |
| 43 | Polyester Resin F | 100 | Symuler Fast Yellow-5GF (C.I. 21095: a product of Dainippon Ink K.K.) | 6 | −9.12 | 78 |
| 44 | " | " | " | " | −6.39 | 78 |
| 45 | " | " | Symuler Fast Yellow-GF (C.I. 21090: a product of Dainippon Ink K.K.) | 3 | −11.67 | 74 |
| 46 | " | " | " | 5 | −11.13 | 78 |
| 47 | " | " | " | 7 | −9.25 | 82 |
| 48 | " | " | " | 10 | −8.32 | 82 |
| 49 | " | " | " | 13 | −7.65 | 82 |

For the sake of comparison, the color purity and triboelectric quantity of the yellow toners prepared by using various kinds of binder resins other than those used in the present invention are shown in the following Table 6.

Table 6

| Comparative Example | Binder Resin (wt. part) | | Pigment (wt. part) | | Triboelectric Quantity (μc/g) | Color Purity (%) |
|---|---|---|---|---|---|---|
| 22 | Polystyrene Resin (PICCOLASTIC D-125) | 100 | Symuler Fast Yellow-GF (C.I. 21090: a product of Dainippon Ink K.K.) | 6 | +0.50 | 69 |
| 23 | Polystyrene Resin ("HIMER-SU-135") | " | " | " | −0.32 | 67 |
| 24 | Epoxy Resin ("ARALDITE 6084") | " | " | " | −0.40 | 82 |
| 25 | Epoxy Resin ("EPIKOTE 1004") | " | " | " | −0.21 | 83 |
| 26 | Phenolic Resin | " | " | " | −2.57 | 65 |
| 27 | Coumarone-Indene Resin | " | " | " | +0.15 | 60 |
| 28 | Polyterpene Resin | " | " | " | −0.43 | 78 |
| 29 | Rosin-modified Maleic Acid Resin | " | " | " | −0.75 | 63 |
| 30 | Rosin-modified Phenolic Resin | " | " | " | −1.23 | 60 |
| 31 | Xylene Resin | " | " | " | +0.23 | 63 |
| 32 | Styrene-methyl methacrylate copolymer Resin | " | " | " | −1.05 | 72 |

Any of the magenta images in Examples 1 through 17, any of the cyan images in Examples 18 through 33, and any of the yellow images in Examples 34 through 49, all having been obtained by developing the electrostatic latent images formed by exposing the original image by a color resolution filter, were registered or superimposed at their predetermined relative positions so as to be transferred onto a transfer sheet, whereby an image of very clear color was obtained.

We claim:

1. A negatively charged toner for electrophotography having enhanced properties of negative chargeability and color purity which comprises a saturated or unsaturated polyester resin having a softening point of from 80° to 150° C and produced from a polyol component and a dicarboxylic acid component and an organic pigment selected from the group consisting of a phthalocyanine type cyan organic pigment, and a benzidine type yellow organic pigment.

2. The negatively charge toner for electrophotography as claimed in claim 1, which contains 100 parts by weight of the polyester resin and 1–15 parts by weight of the organic pigment.

3. The negative charge toner for electrophotography as claimed in claim 2, wherein the content of said organic pigment ranges from 2 to 8 parts by weight.

4. The negative charge toner for electrophotography as claimed in claim 1, wherein the softening point of the polyester resin is from 90° to 110° C.

5. The negatively charged toner for electrophotography as claimed in claim 1, wherein the polyol component constituting said polyester resin is at least one member selected from the group consisting of propylene glycol, neopentyl glycol, and bisphenol A.

6. A negatively charged magenta toner for color electrophotography having enhanced properties of negative chargeability and color purity which comprises 100 parts by weight of a saturated or unsaturated polyester resin having a softening point of from 80° to 150° C and produced from a polyol component and a dicarboxylic acid component and from 2–8 parts by weight of at least one organic pigment selected from the group consisting of a quinacridone type magenta organic pigment and a rhodamine type magenta organic pigment.

7. The negatively charged magenta toner for color electrophotography as claimed in claim 6, wherein the organic pigment is selected from the group consisting of Pigment Red 81 having Color Index No. C.I. 45160 and Pigment Red 122, wherein the softening point of the polyester resin is from 90° to 110° C, and wherein the polyol component constituting said polyester resin is at least one member selected from the group consisting of propylene glycol, neopentyl glycol and bisphenol A.

8. A negatively charged cyan toner for color electrophotography which comprises 100 parts by weight of a saturated or unsaturated polyester resin having a softening point of from 80° to 150° C and produced from a polyol component and a dicarboxylic acid component and from 1 to 15 parts by weight of at least one organic pigment selected from the group consisting of phthalocyanine type organic pigments.

9. The negatively charged cyan toner for color electrophotography as claimed in claim 8, wherein the organic pigment is selected from the group consisting of C.I.74260, C.I.74280, C.I.74255, C.I.74160 and C.I.74180.

10. A negatively charged yellow toner for color electrophotography which comprises 100 parts by weight of a saturated or unsaturated polyester resin having a softening point of from 80° to 150° C and produced from a polyol component and a dicarboxylic acid component and from 1 to 15 parts by weight of at least one organic pigment selected from benzidine type yellow organic pigments.

11. The negatively charged yellow toner for color electrophotography as claimed in claim 10, wherein said organic pigment is selected from the group consisting of C.I.21090, C.I.21095 and C.I.21100.

* * * * *

UNITED STATES PATENT OFFICE
CERTIFICATE OF CORRECTION

Patent No. 3,998,747 Dated December 21, 1976

Inventor(s) HIROSHI YAMAKAMI, KAICHI TSUCHIYA AND SEIZI TOMARI

It is certified that error appears in the above-identified patent and that said Letters Patent are hereby corrected as shown below:

At column 4, after line 23, immediately under the terms:

"Phthalic Anhydride 1.68 mols"

insert:

--Softening Point 98°C--.

In Claim 2, line 1, "charge" should read --charged--.

In Claims 3 and 4, line 1, of each claim "negative charge" should read --negatively charged--.

Signed and Sealed this

First Day of March 1977

[SEAL]

*Attest:*

RUTH C. MASON
*Attesting Officer*

C. MARSHALL DANN
*Commissioner of Patents and Trademarks*